US009472878B2

(12) United States Patent
Costello et al.

(10) Patent No.: US 9,472,878 B2
(45) Date of Patent: Oct. 18, 2016

(54) ELECTRICAL CABLE CONNECTOR HAVING A TWO-DIMENSIONAL ARRAY OF MATING INTERFACES

(71) Applicant: Tyco Electronics Corporation, Berwyn, PA (US)

(72) Inventors: Brian Patrick Costello, Scotts Valley, CA (US); Michael David Herring, Apex, NC (US); Arash Behziz, Newbury Park, CA (US); David Wayne Helster, Dauphin, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/598,928

(22) Filed: Jan. 16, 2015

(65) Prior Publication Data

US 2016/0211598 A1 Jul. 21, 2016

(51) Int. Cl.
*H01R 12/00* (2006.01)
*H01R 12/73* (2011.01)

(52) U.S. Cl.
CPC ..... *H01R 12/73* (2013.01)

(58) Field of Classification Search
CPC ..... H01R 12/73
USPC ..... 439/77, 912, 65, 67, 493, 607.1, 439/607.05, 607.07
See application file for complete search history.

(56) References Cited

U.S. PATENT DOCUMENTS 5,190,480 A * 3/1993 Chau ..... H01R 13/26 439/567
5,433,631 A * 7/1995 Beaman ..... H01R 12/79 439/289
5,502,667 A * 3/1996 Bertin ..... G11C 5/04 257/686
5,579,207 A * 11/1996 Hayden ..... H01L 25/0657 174/261
5,667,401 A * 9/1997 Kuwabara ..... H01R 12/716 439/405
5,910,885 A * 6/1999 Gulachenski ..... H01L 25/105 257/E25.023
6,109,929 A * 8/2000 Jasper ..... G06F 1/184 361/790
6,120,332 A * 9/2000 Bertens ..... H01R 13/514 439/362
6,703,651 B2 * 3/2004 Worz ..... H01L 25/0657 257/209
7,014,472 B2 3/2006 Fjelstad et al.
7,345,359 B2 3/2008 Kim et al.
7,503,767 B2 * 3/2009 Pai ..... H05K 1/144 439/66
7,518,238 B2 4/2009 Lu et al.
7,818,879 B2 * 10/2010 Pai ..... H05K 1/144 174/254
8,308,491 B2 * 11/2012 Nichols ..... H01R 12/73 439/67
8,330,046 B2 * 12/2012 Riebel ..... G01N 33/48785 174/126.4
2003/0190843 A1 * 10/2003 Farnworth ..... H01L 25/0657 439/630
2005/0101164 A1 * 5/2005 Rathburn ..... H01L 23/49811 439/74
2011/0070750 A1 * 3/2011 Reisinger ..... H01R 12/7082 439/66
2011/0108427 A1 5/2011 Gurumurthy et al.

* cited by examiner

*Primary Examiner* — Tulsidas C Patel
*Assistant Examiner* — Peter G Leigh

(57) ABSTRACT

Cable connector including a connector body extending along a longitudinal axis between a mating side and a loading side of the connector body. The connector body is oriented with respect to a mating axis that is perpendicular to the longitudinal axis. The cable connector also includes electrical conductors having body segments that extend through the connector body between the mating and loading sides and contact beams that project from the mating side. The contact beams have mating interfaces that are configured to directly engage corresponding electrical contacts of a mating component during a mating operation. The contact beams are shaped to extend along the longitudinal axis away from the mating side and along the mating axis such that the mating interfaces form a two-dimensional (2D) array that is oriented substantially perpendicular to the mating axis.

20 Claims, 8 Drawing Sheets

ELECTRICAL CABLE CONNECTOR HAVING A TWO-DIMENSIONAL ARRAY OF MATING INTERFACES

BACKGROUND

The subject matter herein relates generally to electrical cable connectors configured to communicate data signals and communication systems that include the same.

Communication systems, such as routers, servers, uninterruptible power supplies (UPSs), supercomputers, and other computing systems, may be complex systems that have a number of components interconnected to one another. For example, a backplane communication system may include several daughter card assemblies that are interconnected to a common backplane. The daughter card assemblies include a circuit board that may have at least one processor mounted thereto and a plurality of electrical connectors mounted thereto. Some of the electrical connectors may mate with corresponding connectors of the backplane, and some of the electrical connectors may mate with other connectors, such as pluggable input/output (I/O) modules, that communicate with remote components. The processor may communicate data signals with the different electrical connectors through traces and vias of the circuit board. Alternatively, a flexible circuit may interconnect the processor to the electrical connectors or other components of the daughter card assembly.

As performance demands and signal speeds increase, however, it has become more challenging to achieve a baseline level of signal quality. For example, it is known that dielectric material of a circuit board or of a flexible circuit may cause signal degradation as the data signals propagate along conductive pathways through the dielectric material. The signal degradation is even greater with higher transmission speeds. Thus, it may be desirable to reduce the distances that the data signals travel through such dielectric material.

In order to reduce the distances that the data signals travel through dielectric material, it has been proposed to use a cable assembly having a cable connector and a bundle of cables coupled to the cable connector. High performance cables may cause less signal degradation than pathways through printed circuit board (PCB) material or flex cable dielectric material. In one known cable assembly, the cables are optical fibers, and the cable connector includes or engages an optical engine that converts the data signals from an electrical form to an optical form (or vice versa). The optical engine is mated to a seating space of a land grid array (LGA) socket that is mounted to the circuit board near the processor. The LGA has a two-dimensional (2D) array of electrical contacts that extend parallel to the circuit board along the seating space. The electrical contacts engage corresponding electrical contacts of the optical engine. The optical fibers extend from the optical engine over the circuit board to other components. In such applications, the data signals may propagate relatively long distances through the optical fibers instead of the dielectric material of the circuit board or flexible circuit.

Converting data signals between an electrical form and an optical form, however, can consume a substantial amount of power and generate a substantial amount of heat within the communication system. For applications in which the LGA socket and the other components are relatively close to each other, such as less than twenty (20) meters, it may be less expensive to directly connect the LGA socket or the processor to the other component through an electrical cable assembly. Conventional electrical cable assemblies, however, are not configured for mating directly to LGA sockets (or processors) in which the corresponding 2D arrays extend parallel to the circuit board.

Accordingly, a need exists for an electrical cable assembly having a 2D array of electrical contacts that is configured to engage another 2D array of electrical contacts that extend along or parallel to a circuit board.

BRIEF DESCRIPTION

In an embodiment, a cable connector is provided that includes a connector body extending along a longitudinal axis between a mating side and a loading side of the connector body. The connector body is oriented with respect to a mating axis that is perpendicular to the longitudinal axis. The cable connector also includes electrical conductors having body segments that extend through the connector body between the mating and loading sides and contact beams that project from the mating side. The contact beams have mating interfaces that are configured to directly engage corresponding electrical contacts of a mating component during a mating operation. The contact beams are shaped to extend along the longitudinal axis away from the mating side and along the mating axis such that the mating interfaces form a two-dimensional (2D) array that is oriented substantially perpendicular to the mating axis.

In an embodiment, a cable connector is provided that includes a plurality of cable modules stacked side-by-side along a mating axis to form a connector body. The connector body extends along a longitudinal axis that is perpendicular to the mating axis between a mating side and a loading side of the connector body. Each of the cable modules includes a module body and a plurality of electrical conductors extending along the longitudinal axis through the module body. The electrical conductors of the cable modules include contact beams that project from the module bodies at the mating side of the connector body and are shaped to extend along the mating axis. The contact beams have mating interfaces that are configured to directly engage corresponding electrical contacts of a mating component. The contact beams are shaped such that the mating interfaces form a two-dimensional (2D) array that is oriented substantially perpendicular to the mating axis.

In an embodiment, a communication system is provided that includes a cable connector having a connector body that extends along a longitudinal axis between a mating side and a loading side of the connector body. The cable connector includes a plurality of electrical conductors that have body segments extending through the connector body between the mating and loading sides and contact beams that project from the connector body at the mating side. The contact beams have mating interfaces and are shaped to extend along a mating axis that is perpendicular to the longitudinal axis such that the mating interfaces form a two-dimensional (2D) array. The communication system also includes a circuit board having a board surface that faces along the mating axis in a mating direction. The circuit board has an array of board contacts along the board surface. The 2D array of the cable connector is configured to engage the array of board contacts during a mating operation in which at least one of the cable connector or the circuit board is moved along the mating axis. The contact beams are deflected along the mating axis during the mating operation.

DETAILED DESCRIPTION

Embodiments set forth herein include cable connectors and cable assemblies having electrical contacts that form two-dimensional (2D) arrays. The electrical contacts include mating interfaces that are configured to directly engage corresponding contacts. The mating interfaces are positioned to be substantially co-planar and thereby form the 2D array. Unlike conventional cable connectors that include 2D arrays positioned along a front end of the cable connector and facing in a forward or mating direction, the 2D arrays of some embodiments face in a direction that is perpendicular to the forward direction. In such embodiments, the 2D array of the cable connector may extend parallel to a corresponding 2D array of a mating component, such as a daughter card or processor.

As used herein, the term "2D array," when used in the detailed description or the claims, includes the mating interfaces being distributed in a designated manner along at least two dimensions. A 2D array does not require that the mating interfaces be co-planar when the cable connector and the mating component are disengaged from each other. For example, one or more of the mating interfaces may have a different depth or Z-position with respect to other mating interfaces when the 2D array is not engaged with a complementary array of the mating component contact points. After the 2D array is engaged to a complementary array of the mating component contact points, the mating interfaces of the 2D array may be co-planar.

As used herein, the phrase "a plurality of," when used in the detailed description or the claims, does not necessarily include each and every element that a component may have. For example, the phrase "a plurality of contact beams" does not necessarily include each and every contact beam of the cable connector. Likewise, the phrase "a 2D array of mating interfaces" (or the like) does not necessarily include each and every mating interface of the cable connector. For instance, a single cable connector may form multiple 2D arrays in which each 2D array includes a different set of mating interfaces.

Figure 1:
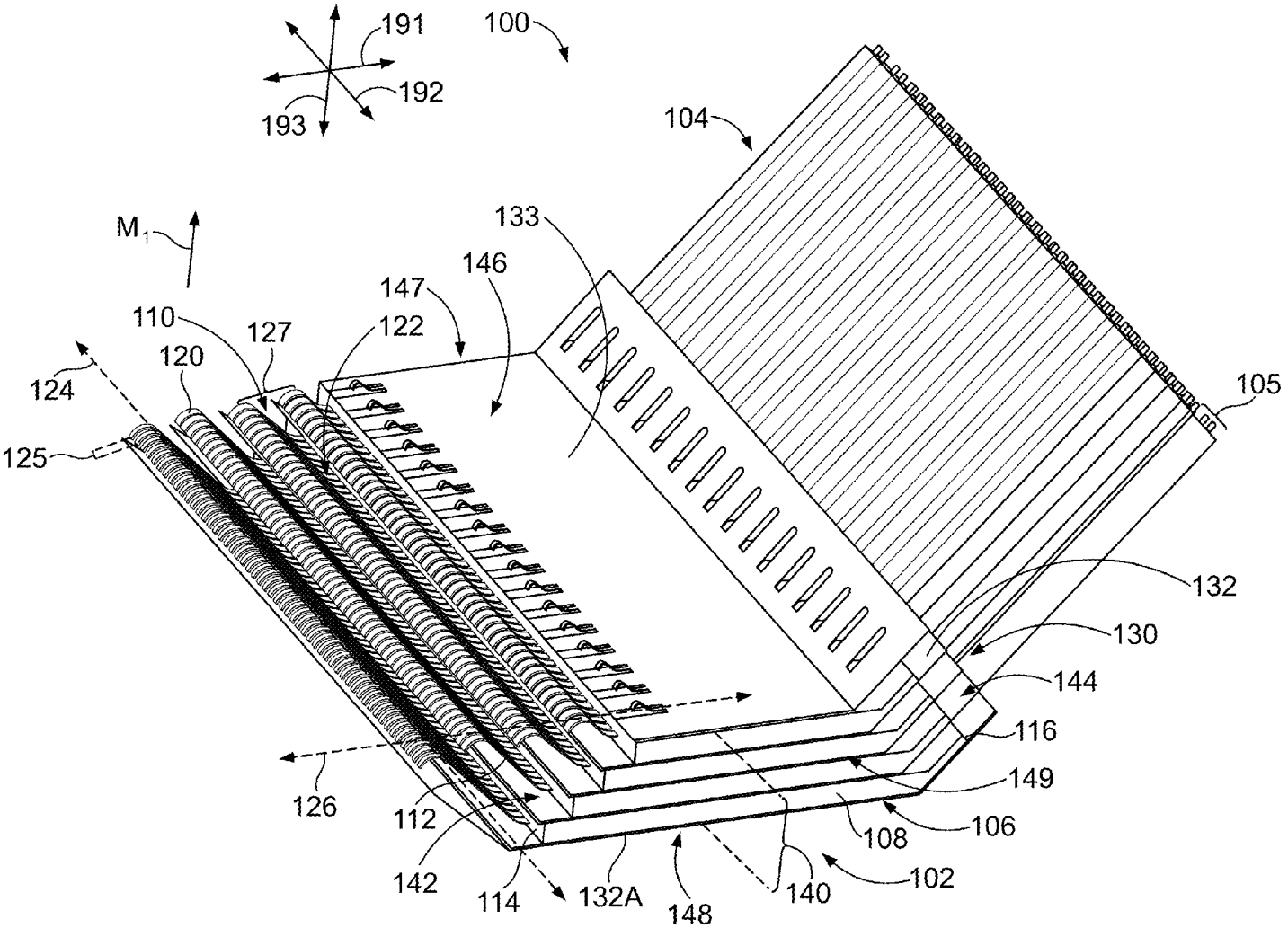
FIG. 1 is a perspective view of a cable assembly formed in accordance with an embodiment.

FIG. 1 is a front perspective view of a portion of a cable assembly 100 formed in accordance with an embodiment. The cable assembly 100 includes a cable connector 102 and a plurality of insulated wires 104 that are coupled to the cable connector 102. In an exemplary embodiment, the insulated wires 104 may form a plurality of parallel-pair cables 105 in which each cable 105 includes a pair of the insulated wires 104. Although not shown, the cable connector 102 may be interconnected to one or more communication devices through the insulated wires 104. For example, some of the insulated wires 104 may couple to a first communication device and some of the insulated wires 104 may couple to a second communication device. As used herein, a communication device may be another cable connector that is similar or identical to the cable connector 102 or a different type of communication device. For example, the communication device may be a receptacle assembly in alternative embodiments. As shown, the cable assembly 100 is oriented with respect to mutually perpendicular axes 191, 192, and 193, including a longitudinal axis 191, a lateral axis 192, and a mating axis 193.

The cable connector 102 includes a connector body 140 having a mating side 142 and a loading side 144. The mating side 142 and the loading side 144 are generally located on opposite ends of the connector body 140. In certain embodiments, the cable connector 102 includes a plurality of cable modules 106 that are stacked side-by-side along the mating axis 193. In FIG. 1, the cable connector 102 includes four cable modules 106 stacked side-by-side, but fewer cable modules 106 or more cable modules 106 may be used in other embodiments.

Each of the cable modules 106 includes a module body 108 and a plurality of electrical conductors 110. The module bodies 108 may include a dielectric material that surrounds or encases one or more portions of the electrical conductors 110. The module bodies 108 may collectively form the connector body 140. The electrical conductors 110 extend through the corresponding module body 108 and include contact beams 112 that project from the corresponding module body 108.

Each of the module bodies 108 includes opposite front and back ends 114, 116. The electrical conductors 110 include body segments 160 (shown in FIG. 2) that extend between the front and back ends 114, 116. The contact beams 112 project from the front ends 114 of the corresponding module bodies 108. Each of the contact beams 112 includes a mating interface 120 that is configured to directly engage a corresponding electrical contact of a mating component 230 (shown in FIG. 7). The mating component 230 may be, for example, a circuit board or a processor.

The contact beams 112 are shaped to extend away from the connector body 140 along the longitudinal axis 191 and also along the mating axis 193. The contact beams 112 are shaped such that the mating interfaces 120 form a two-dimensional (2D) array 122. The 2D array 122 extends parallel to the longitudinal axis 191 and parallel to the lateral axis 192. The 2D array 122 is positioned substantially normal or perpendicular to the mating axis 193. As such, the 2D array 122 may be characterized as facing in a mating direction $M_1$ along the mating axis 193. However, the mating interfaces 120 are not required to be co-planar. For example, each mating interface 120 may have a Z-position relative to the mating axis 193. Different mating interfaces 120 may have different Z-positions before and/or after the cable connector 102 and the mating component 230 are engaged. In some embodiments, the mating interfaces 120 may be substantially co-planar. For example, the Z-positions may differ by at most 2 millimeters (mm) along the mating axis 193.

The 2D array 122 is configured to engage a corresponding array 240 (shown in FIG. 7) of the mating component 230 during a mating operation between the cable connector 102 and the mating component 230. During the mating operation, the mating component 230 may be moved along the mating axis 193 toward cable connector 102 and/or the cable connector 102 may be moved along the mating axis 193 toward the mating component 230. The 2D array 122 and the array 240 of the mating component 230 may face each other during the mating operation. When the 2D array 122 engages the array 240, the contact beams 112 may flex and move along the mating axis 193 such that the Z-positions of the mating interfaces 120 change. In some embodiments, the mating interfaces 120 are co-planar when the cable connector 102 and the mating component 230 are engaged.

In the illustrated embodiment, the mating interfaces 120 form a plurality of rows 124 (indicated by a dashed line in FIG. 1) that extends along the lateral axis 192 and a plurality of columns 126 (indicated by a dashed line in FIG. 1) that extend along the longitudinal axis 191. The mating interfaces 120 of a single row 124 may have a common center-to-center spacing or pitch 125 between adjacent mating interfaces 120 in the same row 124. The center-to-center spacing 125 may be, for example, about 0.5 mm. The mating interfaces 120 of a single column 126 may have a common center-to-center spacing or pitch 127 between adjacent mating interfaces 120 in the same column 126. The center-to-center spacing 127 may be, for example, about 2.5 mm.

In some embodiments, the 2D array 122 may form a high density array of mating interfaces 120. For example, the 2D array 122 may have at least 15 mating interfaces 120 per 100 $mm^2$ or at least 25 mating interfaces 120 per 100 $mm^2$. In more particular embodiments, the 2D array 122 may have at least 35 mating interfaces 120 per 100 $mm^2$ or at least 50 mating interfaces 120 per 100 $mm^2$.

As described herein, each mating interface 120 may have a Z-position relative to the mating axis 193. In a similar manner, various features or elements of the embodiments set forth herein may have different locations within a three-dimensional (3D) space that are defined relative to the longitudinal axis 191, the lateral axis 192, and the mating axis 193. For instance, each spatial location may have a Z-position that is measured relative to the mating axis 193, but also an X-position that is measured relative to the longitudinal axis 191 and a Y-position that is measured relative to the lateral axis 192. By way of example, the mating interfaces 120 of the 2D array 122 have similar Z-positions, but may have different X- and Y-positions. For instance, the mating interfaces 120 of each row 124 have the same X-position, but different Y-positions. The mating interfaces 120 of each column 126 have the same Y-position, but different X-positions.

The connector body 140 includes opposite connector sides 147, 149 that face in opposite directions along the lateral axis 192. The connector sides 147, 149 extend along the longitudinal axis 191 between the mating and loading sides 142, 144. In the illustrated embodiment, the connector sides 147, 149 are substantially planar, but the connector sides 147, 149 may have other contours in other embodiments. The connector body 140 also includes a first exterior side 146 and a second exterior side 148 that face in opposite directions along the mating axis 193. The first exterior side 146 and the second exterior side 148 extend between the mating and loading sides 142, 144 along the longitudinal axis 191 and between the connector sides 147, 149 along the lateral axis 192.

In some embodiments, the front ends 114 of the module bodies 108 are positioned along and may combine to form the mating side 142. In the illustrated embodiment, the modules bodies 108 have different sizes and/or shapes such that the front ends 114 form a stair- or step-like structure along the mating side 142. In some embodiments, the back ends 116 of the module bodies 108 are positioned along and may combine to form the loading side 144. The front ends 114 face in a direction that is parallel to the longitudinal axis 191, and the back ends 116 face in a direction that is angled with respect to the longitudinal axis 191.

The cable connector 102 may also include a shield assembly 130 that has ground shields 132, 133. The ground shields 132, 133 may be positioned along corresponding module bodies 108. In the illustrated embodiment, three of the ground shields 132 are positioned between adjacent module bodies 108. Also shown, at least a portion of the ground shield 133 may include or define the first exterior side 146 of the connector body 140. The ground shields 132 include a ground shield 132A that may include or define the second exterior side 148 of the connector body 140. In some embodiments, the mating component 230 may engage or interface with the first exterior side 146 when the mating component 230 is communicatively coupled to the 2D array 122 of the mating interfaces 120.

Figure 2:
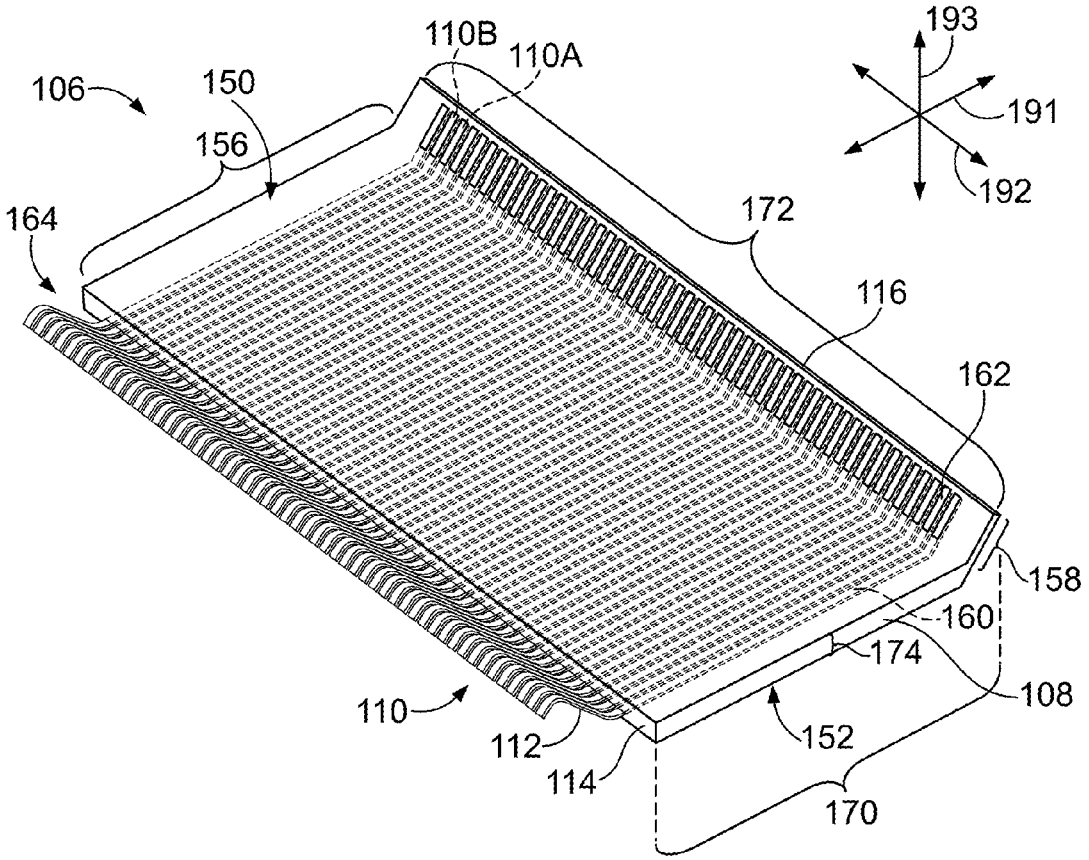
FIG. 2 is an isolated perspective view of a portion of a cable module that may be used with the cable assembly of FIG. 1.

FIG. 2 is an isolated perspective view of an exemplary cable module 106. For illustrative purposes, the ground shields 132 and/or 133 (FIG. 1) has/have been removed. The electrical conductors 110 extend through the module body 108 between the front end 114 and the back end 116. Each of the electrical conductors 110 includes a corresponding contact beam 112, a body segment 160 (shown in phantom) that extends between the front end 114 and the back end 116 of the module body 108, and a terminating segment 162 that is positioned proximate to the back end 116. In the illustrated embodiment, the body segment 160 is substantially encased by the dielectric material of the module body 108. At least a portion of the terminating segment 162, however, is exposed to an exterior of the cable module 106. The terminating segment 162 is configured to mechanically and electrically engage a wire conductor 206 (shown in FIG. 4) of one of the insulated wires 104 (FIG. 1).

The body segment 160 extends between a corresponding contact beam 112 and a corresponding terminating segment 162. In the illustrated embodiment, each of the electrical conductors 110 is a single unitary strip or trace of conductive material, such as copper. For example, the electrical conductor 110 may be stamped and formed from a sheet of the conductive material. In other embodiments, however, the electrical conductor 110 includes distinct or discrete conductive segments that are assembled or coupled together to form the electrical conductor 110. For example, in alternative embodiments, each electrical conductor may include a contact beam that is terminated to an end of a body segment.

The module body 108 surrounds or encases one or more portions of the electrical conductors 110. For example, the electrical conductors 110 may be stamped and formed from a common sheet of the conductive material to provide a lead frame 164. The dielectric material may then be formed around the lead frame 164. For example, the lead frame 164 may be disposed within a mold cavity (not shown) and the dielectric material may be injected into the mold cavity to encase designated portions of the electrical conductors 110. In some embodiments, each of the electrical conductors 110 is separate from the other electrical conductors 110 when the lead frame 164 is overmolded with the dielectric material. In other embodiments, the electrical conductors 110 may include links or bridges (not shown) that join the electrical conductors 110 of the lead frame 164. In such embodiments, after the lead frame 164 is overmolded with the dielectric material, the links or bridges may be removed such that the electrical conductors 110 are electrically isolated from one another.

During operation, some of the electrical conductors 110 function as signal conductors 110A that carry data signals therethrough and some of the electrical conductors 110 function as ground conductors 110B that are positioned to electrically separate the signal conductors 110A from one another. In some embodiments, the signal conductors 110A may form differential pairs in which adjacent differential pairs have at least one ground conductor 110B therebetween. For example, the electrical conductors 110 of the lead frame 164 may be arranged to have a repeating series of ground conductor 110B, signal conductor 110A, signal conductor 110A, ground conductor 110B. It should be understood, however, that other lead frame configurations may be used in other embodiments.

In the illustrated embodiment, the module body 108 has a first body side 150 and an opposite second body side 152. The first and second body sides 150, 152 are shaped to allow the cable modules 106 to be stacked on top of one another along the mating axis 193. In some embodiments, the first and second body sides 150, 152 are substantially planar. In other embodiments, the first and second body sides 150, 152 of one module body 108 may include non-planar features, such as projections and recesses, that complement other non-planar features of the adjacent module bodies 108.

The module body 108 may have recesses or windows 154, 155 (shown in FIG. 5) that extend into and, optionally, entirely through the module body 108. The recesses 154 may provide access to the electrical conductors 110 through the module body 108. For example, the recesses 154 may permit the ground shields 132 (FIG. 1) to electrically couple to the ground conductors 110B. In some cases, the recesses 155 may be located to control or improve electrical performance. For example, at least one of the recesses 155 may provide an air dielectric that is configured to achieve a desired impedance for the cable connector 102 (FIG. 1).

The module body 108 has a length 170 that is measured along the longitudinal axis 191, a width 172 that is measured along the lateral axis 192, and a thickness 174 that is measured between the first and second body sides 150, 152. The module body 108 may include different sections that have respective different dimensions. For example, the module body 108 includes a conductor section 156 and a cable-terminating section 158. The conductor section 156 extends between the front end 114 and the cable-terminating section 158. The cable-terminating section 158 extends between the conductor section 156 and the back end 116. The cable-terminating section 158 is configured to expose at least portions of the terminating segments 162 of the electrical conductors 110. For example, the thickness 174 of the module body 108 along the conductor section 156 may be greater than the thickness 174 of the module body 108 along the cable-terminating section 158. In particular embodiments, the thickness 174 is reduced along the cable-terminating section 158 to expose the terminating segments 162.

Figure 3:
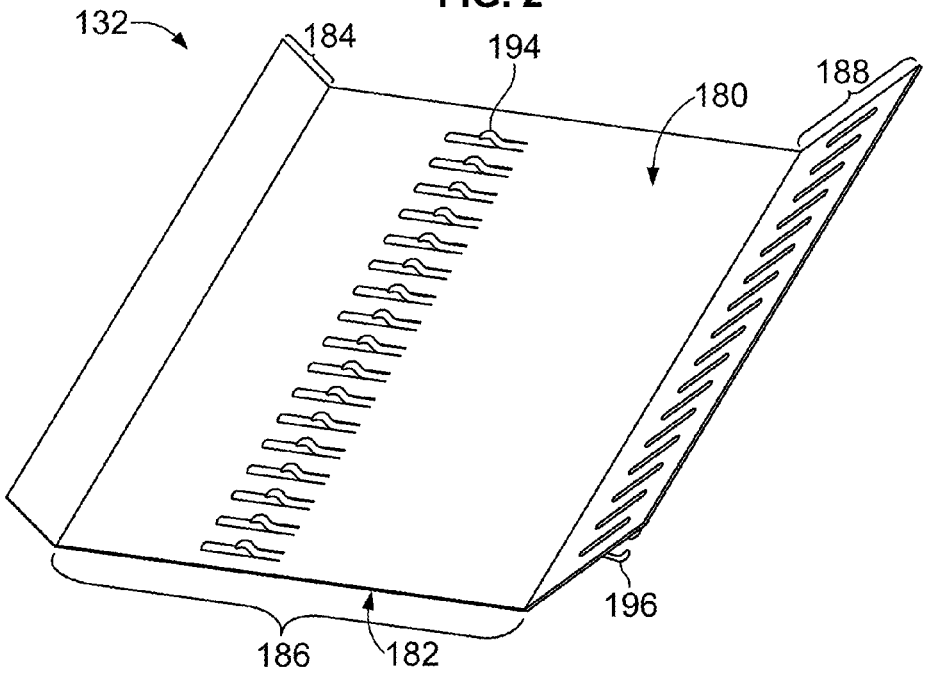
FIG. 3 is an isolated perspective view of a ground shield that may be used with the cable assembly of FIG. 1.

FIG. 3 is an isolated perspective view of an exemplary ground shield 132. In some embodiments, the ground shield 132 comprises a stamped-and-formed sheet of conductive material. As shown, the ground shield 132 includes a first side surface 180 and an opposite second side surface 182. The ground shield 132 includes a forward panel 184, a body panel 186, and a rearward panel 188. The first side surface 180 may be shaped to complement the second body side 152 (FIG. 2) of a corresponding module body 108 (FIG. 1) such that the ground shield 132 receives the module body 108. For example, the ground shield 132 may be configured to be positioned along the module body 108 such that the body panel 186 and, optionally, the rearward panel 188 directly engage the second body side 152. The module body 108 may also be characterized as nesting within the ground shield 132. The forward panel 184 is configured to be positioned between the contact beams 112 (FIG. 1) of adjacent cable modules 106 (FIG. 1).

In particular embodiments, the ground shield 132 includes shield fingers 194 and shield fingers 196. The shield fingers 194 project from the first side surface 180, and the shield fingers 196 project from the second side surface 182. When the ground shield 132 is positioned between adjacent cable modules 106 (FIG. 1), the shield fingers 194 may engage ground conductors 110B (FIG. 2) of one of the cable modules 106, and the shield fingers 196 may engage ground conductors 110B of another cable module 106. In the illustrated embodiment, the shield fingers 194 are located along the body panel 186 and the shield fingers 196 are located along the rearward panel 188. However, the shield fingers 194, 196 may have other locations or positions in alternative embodiments.

Figure 4:
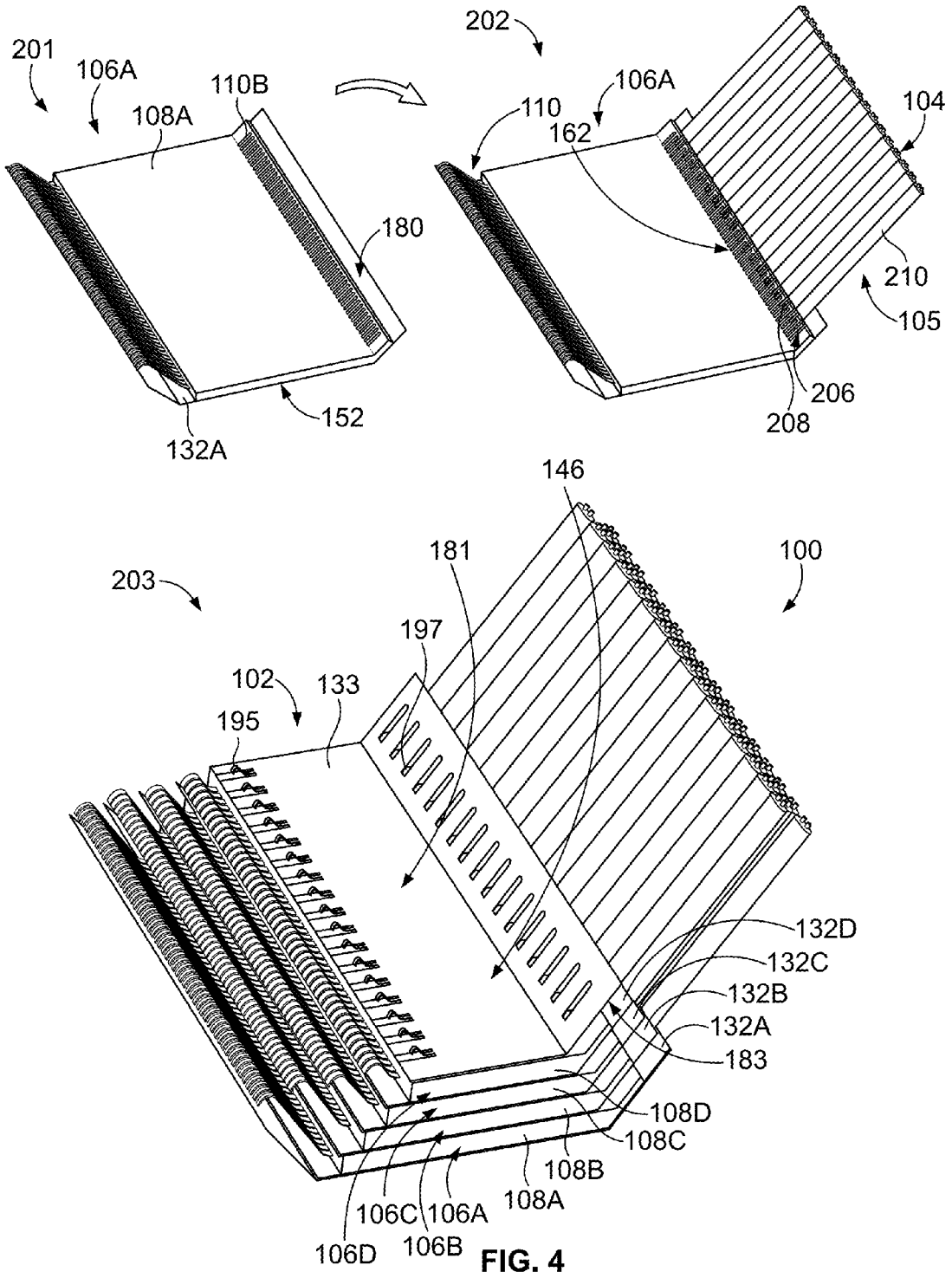
FIG. 4 illustrates different stages for constructing the cable assembly of FIG. 1 from a plurality of the cable modules.

FIG. 4 illustrates different stages 201, 202, and 203 for constructing the cable assembly 100. Hereinafter, the cable modules may be referenced more specifically as the cable modules 106A, 106B, 106C, and 106D. In the illustrated embodiment, the cable module 106A functions as a bottom of the cable connector 102. As shown by the fully assembled cable connector 102 in FIG. 4, the cable module 106B is stacked onto the cable module 106A, the cable module 106C is stacked onto the cable module 106B, and the cable module 106D is stacked onto the cable module 106C. The module bodies of the cable modules 106A-106D are referenced as the module bodies 108A, 108B, 108C, and 108D, respectively, and the ground shields of the cable modules 106A-106D are referenced as the ground shields 132A, 132B, 132C, and 132D, respectively.

At stage 201, the module body 108A may be mounted onto the first side surface 180 of the ground shield 132A. As the module body 108A is positioned onto the ground shield 132A, the shield fingers 194 (FIG. 3) of the ground shield 132A may be positioned within corresponding recesses 154 (shown in FIG. 5). The shield fingers 194 may engage corresponding ground conductors 110B thereby electrically connecting the ground conductors 110B to the ground shield 132A.

The module body 108A may be attached to the ground shield 132A in various manners. For example, an adhesive may be applied to the first side surface 180 of the ground shield 132A and/or the second body side 152 of the module body 108A. As another example, the ground shield 132A may include one or more features that engage the module body 108A. For instance, the ground shield 132A may include projections or tabs that extend into corresponding recesses of the module body 108A and frictionally engage the module body 108. As another example, the ground shield 132A may include latches that grip edges of the module body 108A. Alternatively or in addition to the above, after each of the cable modules 106A-106D is formed and stacked with respect to the other cable modules, another component may grip and hold the cable modules 106A-106D together. For example, the stacked cable modules 106A-106D may be positioned between two housing shells that, when coupled, form a housing that surrounds the cable connector 102.

At stage 202, the insulated wires 104 may be terminated to the terminating segments 162 of the electrical conductors 110 of the cable module 106A. For instance, the insulated wires 104 may include wire conductors 206 surrounded by insulation layers (not shown). The insulation layers are removed (e.g., stripped) at ends of the insulated wires 104 to provide exposed ends 208 of the wire conductors 206. The exposed ends 208 may be mechanically and electrically coupled to the terminating segments 162 of the electrical conductors 110 using, for example, a conductive epoxy. In an exemplary embodiment, the insulated wires 104 form parallel-pair cables 105 in which each cable 105 includes a pair of insulated wires 104 that extend parallel to each other for a length of the cable 105. Each cable 105 has a common jacket 210 that surrounds the pair of insulated wires 104 within the cable 105. The common jacket may be electrically conductive, as in the illustrated embodiment, and electrically terminated to ground shields 132 and 133. It should be understood, however, that one or more other types of insulated wires and/or cables may be used. For examples, the cables 105 may include twisted pairs of insulated wires 104.

Stages 201 and 202 may be repeated to assemble each of the cable modules 106B, 106C, and 106D. As shown at stage 203, after the cable modules 106A-106D are individually assembled, the cable modules 106A-106D may be stacked or nested on top of each other to form the cable connector 102. Alternatively, the stacking may occur as the cable modules 106A-106D are assembled. For example, after the cable module 106A is assembled and the insulated wires 104 terminated to the electrical conductors 110 as described with respect to stage 202, the ground shield 132B may be mounted to the module body 108A. Subsequently, the module body 108B may be mounted onto the ground shield 132B in a similar manner as described above with respect to stage 201. With the module body 108B secured to the ground shield 132B, the wire conductors 206 of the insulated wires 104 may be terminated to the terminating segments 162 of the module body 108B in a similar manner as described above with respect to stage 202 for the cable module 106A. Accordingly, a series of cable modules 106A-106D may be stacked or nested on top of each other to construct the cable connector 102.

At stage 203, the ground shield 133 may be attached to the module body 108D. The ground shield 133 may be attached in a similar manner as described above with respect to the ground shield 132A and the module body 108A. The ground shield 133 may also be similar to the ground shields 132A-132D. For example, the ground shield 133 comprises a stamped-and-formed sheet of conductive material. The ground shield 133 includes opposite first and second side surfaces 181, 183. The first side surface 181 may include or define a portion of the first exterior side 146. The second side surface 183 may engage the module body 108D. In the illustrated embodiment, the ground shield 133 includes shield fingers 195 that project from the first side surface 181, and shield fingers 197 that project from the second side surface 183. The shield fingers 195 are configured to directly engage the mating component 230 (FIG. 7). As described with respect to FIG. 6, the shield fingers 197 are configured to directly engage corresponding terminating segments 162 extending along the module body 108D.

Figure 5:
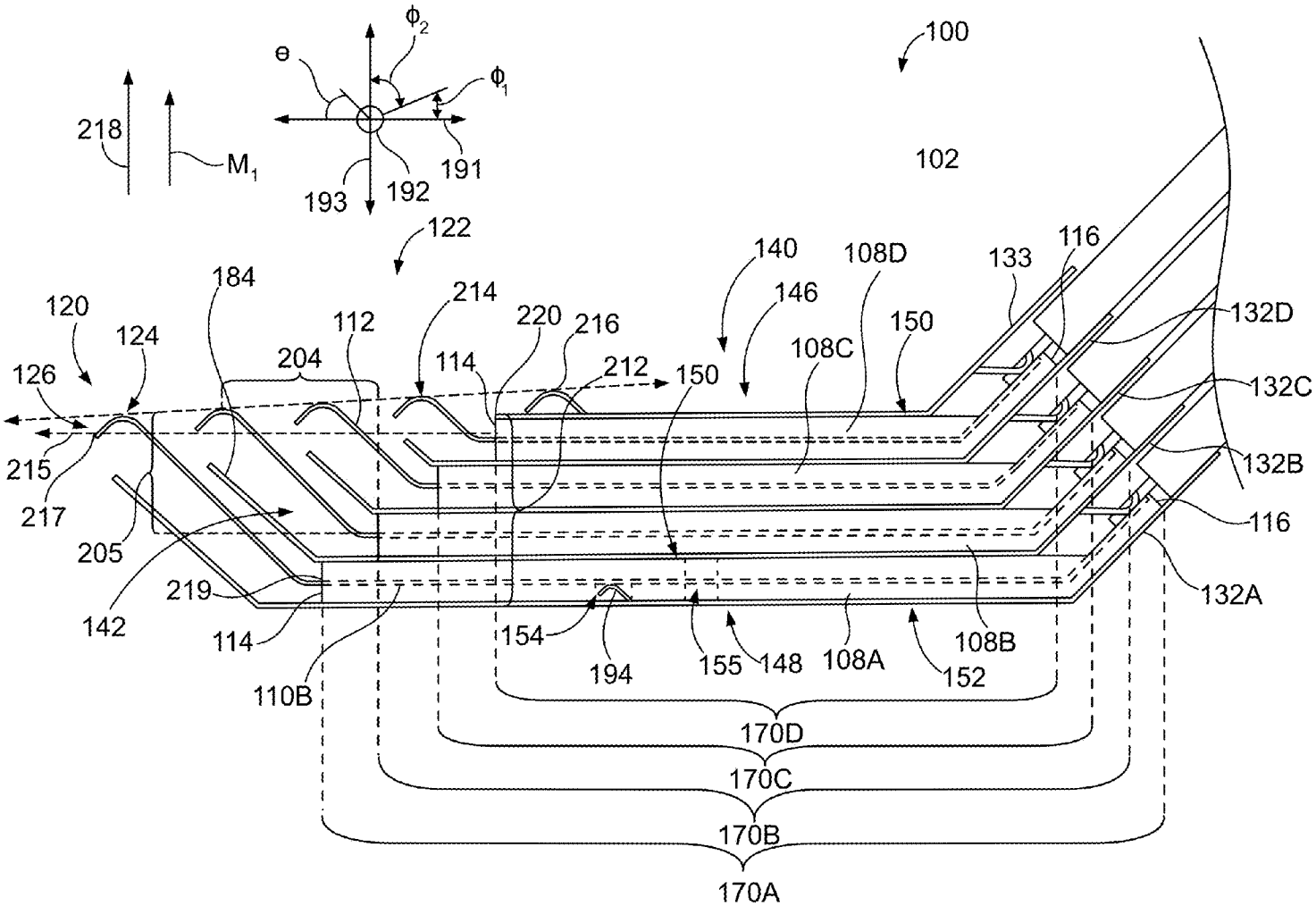
FIG. 5 is a side view of the cable assembly of FIG. 1.

FIG. 5 is a side view of the cable assembly 100. As shown, the contact beams 112 are shaped to position the mating interfaces 120 within the 2D array 122. For example, a beam plane 215 extending perpendicular to the mating axis 193 may intersect each of the contact beams 112 that form the 2D array 122. In the illustrated embodiment, the beam plane 215 also intersects the mating side 142. Also shown, the mating interfaces 120 of the 2D array 122 may be substantially co-planar such that an array plane 216 substantially coincides with the 2D array 122. As used herein, a 2D array of mating interfaces may "substantially coincide" with an array plane if the mating interfaces of the 2D array are within a nominal distance from the array plane. For example, each of the mating interfaces 120 has a curved contour that forms an inflection point or apex 214 of the corresponding contact beam 112. As shown in FIG. 5, the array plane 216 may intersect each of the inflection points 214 of the mating interfaces 120. As such, the 2D array 122 substantially coincides with the array plane 216.

In other embodiments, however, the mating interfaces 120 of the 2D array 122 may not be co-planar such that a single plane does not intersect each of the mating interfaces 120. This may occur when, for example, the mating interfaces 120 have alternating Z-positions. For instance, the mating interfaces 120 corresponding to the ground conductors 110B (FIG. 2) may be positioned to engage the mating component 230 (FIG. 7) before the mating interfaces 120 that correspond to the signal conductors 110A (FIG. 2) engage the mating component 230. For embodiments in which a single plane does not intersect each of the mating interfaces 120, the array plane 216 may be defined by an average Z-position of the mating interfaces 120. If each of the Z-positions of the mating interfaces 120 is within a nominal distance from the array plane 216, then the 2D array 122 may be characterized as substantially coinciding with the array plane 216. For example, if each of the inflection points 214 of the 2D array 122 is within 2.5 mm of the array plane 216, then the 2D array 122 may substantially coincide with the array plane 216. In more particular embodiments, if each of the inflection points 214 of the 2D array 122 is within 1.5 mm of the array plane 216, then the 2D array 122 may substantially coincide with the array plane 216.

In some embodiments, the array plane 216 may extend substantially parallel to the longitudinal axis 191, substantially parallel to the lateral axis 192, and substantially perpendicular to the mating axis 193. As used herein, an array plane is "substantially parallel" to a longitudinal axis or a lateral axis if the array plane forms an orientation angle $\Phi_1$ with respect to the longitudinal axis or lateral axis that is within plus or minus 20°. In more particular embodiments, the orientation angle $\Phi_1$ may be within plus or minus 10°. As used herein, an array plane is "substantially perpendicular" to a mating axis if the array plane forms an orientation angle $\Phi_2$ with respect to the mating axis that is at least +70° or at most +110°. In more particular embodiments, the orientation angle $\Phi_2$ may be at least +80° or at most +100°.

Each of the contact beams 112 may be sized and shaped so that the corresponding mating interface 120 has a designated spatial location within the 2D array 122. To this end, the contact beams 112 are shaped to extend along both the longitudinal axis 191 and the mating axis 193. In particular, the contact beams 112 are shaped such that each mating interface 120 is located a longitudinal distance away from the corresponding front end 114 and a vertical distance from the first body side 150 of the corresponding module body 108. By way of example, the contact beams 112 projecting from the front end 114 of the module body 108B are shaped such that the mating interfaces 120 are located a longitudinal distance 204 away from the corresponding front end 114 and a vertical or mating distance 205 away from the first body side 150. The longitudinal and vertical distances are measured relative to the longitudinal and mating axes 191, 193, respectively.

Accordingly, the contact beams 112 may have different lengths and/or shapes for each mating interface 120 to be located within the 2D array 122. In the illustrated embodiment, the contact beams 112 have similar shapes, but different lengths. A length of a contact beam 112 may be measured between a distal end or tip 217 of the contact beam 112 and a projection point 219. The projection point 219 represents the point at which the contact beam 112 couples to the corresponding module body 108. Each of the projection points has a Z-position relative to mating axis 193. At least some of the Z-positions of the projection points 219 are different. For example, the contact beams 112 associated with different rows 124 have projection points 219 with different Z-positions.

In the illustrated embodiment, the contact beams 112 coupled to the module body 108A have lengths that are longer than the lengths of the contact beams 112 that are coupled to the module bodies 108B-108D. Likewise, the contact beams 112 coupled to the module body 108B have lengths that are longer than the lengths of the contact beams 112 that are coupled to the module bodies 108C, 108D. The contact beams 112 coupled to the module body 108C have lengths that are longer than the lengths of the contact beams 112 coupled to the module body 108D.

In some embodiments, the contact beams 112 are configured to provide a designated deflection resiliency. Various parameters of a contact beam 112, such as the length, a width, or a thickness of the contact beams 112, may be configured such that the contact beam 112 permits deflection along the mating axis 193 while providing a resilient force 218 in the mating direction $M_1$. The resilient force 218 may be configured such that the mating interface 120 and an electrical contact of the mating component 230 (FIG. 7) maintain sufficient electrical contact throughout operation of the cable connector 102.

Also shown in FIG. 5, the modules bodies 108A-108D may have respective body lengths 170A, 170B, 170C, 170D that are measured along the longitudinal axis 191 between the front end 114 and the back end 116 of the respective module body. In the illustrated embodiment, each of the body lengths 170A-170D is different from the other body lengths. In other embodiments, one or more of the module bodies 108A-108D may have the same body length as another module body.

In the illustrated embodiment, the front ends 114 of the module bodies 108A-108D are not flush or even with each other. Instead, the mating side 142 forms a step- or stair-like structure in which each front end 114 is offset with respect to front end(s) 114 of adjacent module bodies. For example, the front end 114 of the module body 108B is located in front of the front end 114 of the module body 108C and located behind the front end 114 of the module body 108A. More specifically, each of the front ends 114 may have an X-position along the longitudinal axis 191 that is different than the X-positions of the other front ends 114. In a similar manner, each of the back ends 116 may have an X-position along the longitudinal axis 191 that is different than the X-positions of the other back ends 116. In alternative embodiments, the front ends 114 are flush or even with each other and/or the back ends 116 are flush or even with each other.

When the cable connector 102 is fully assembled, the module bodies 108A-108D and the ground shields 132A-132D and 133 are stacked along the mating axis 193. The ground shields 132B-132D are disposed between adjacent module bodies. In the illustrated embodiment, the forward panels 184 of the ground shields 132B-132D may extend generally parallel to the contact beams 112. For example, each of the forward panels 184 may extend at a shield angle θ with respect to the longitudinal axis 191. One or more of the forward panels 184 may extend between the contact beams 112 of adjacent rows 124. For example, the forward panel 184 of the ground shield 132B is disposed between the contact beams 112 extending from the module body 108A and the contact beams 112 that extend from the module body 108B. In an exemplary embodiment, the forward panels 184 of the ground shields 132A-132D extend parallel to each other.

The connector body 140 has an operative vertical dimension 212 that is measured along the mating axis 193. As used herein, the term "operative vertical dimension" is not intended to require any particular orientation with respect to gravity. For example, the mating axis 193 in FIG. 5 may extend parallel to the direction of gravity in some embodiments. In other embodiments, however, the lateral axis 192 or the longitudinal axis 191 may extend parallel to the direction of gravity. In some embodiments, the operative vertical dimension may represent a height or thickness of the connector body 140.

The operative vertical dimension 212 extends between the first exterior side 146 and the second exterior side 148. For example, the operative vertical dimension 212 extends between a connector edge 220 and the second exterior side 148. The mating side 142 and the first exterior side 146 join each other along the connector edge 220. More specifically, the front end 114 of the module body 108D and the first exterior side 146 join each other along the connector edge 220. The connector edge 220 may extend parallel to the lateral axis 192 into the page in FIG. 5.

Relative to the mating axis 193, at least some of the mating interfaces 120 of the 2D array 122 may clear the connector edge 220 or the first exterior side 146. For example, at least some of the mating interfaces 120 may be located above the connector edge 220 or the first exterior side 146. In some embodiments, the array plane 216 is positioned such that the array plane 216 is above the mating side 142 of the connector body 140 relative to the mating axis 193. For example, the array plane 216 does not intersect the mating side 142 in FIG. 5.

Also shown in FIG. 5, the module body 108A includes recesses 154, 155 that open along the second body side 152 of the module body 108A. The recess 154 provides access for one of the shield fingers 194 of the ground shield 132A to engage a corresponding ground conductor 110B that extends through the module body 108A. The shield finger 194 is not shown in phantom in FIG. 5 so that the shield finger 194 may be more clearly viewed. It should be understood, however, that the shield fingers 194 are located within corresponding recesses 154 that are defined by corresponding module bodies 108. The recess 155 provides an air dielectric that may be configured to achieve a desired electrical performance for the cable connector 102 (FIG. 1). Although FIG. 5 shows only one recess 154 and one recess 155, it should be understood that each of the module bodies 108A-108D may have a plurality of recesses 154, 155. Accordingly, the ground shield 132A may be electrically commoned to the ground conductors 110B in the module body 108A by the shield fingers 194.

Figure 6:
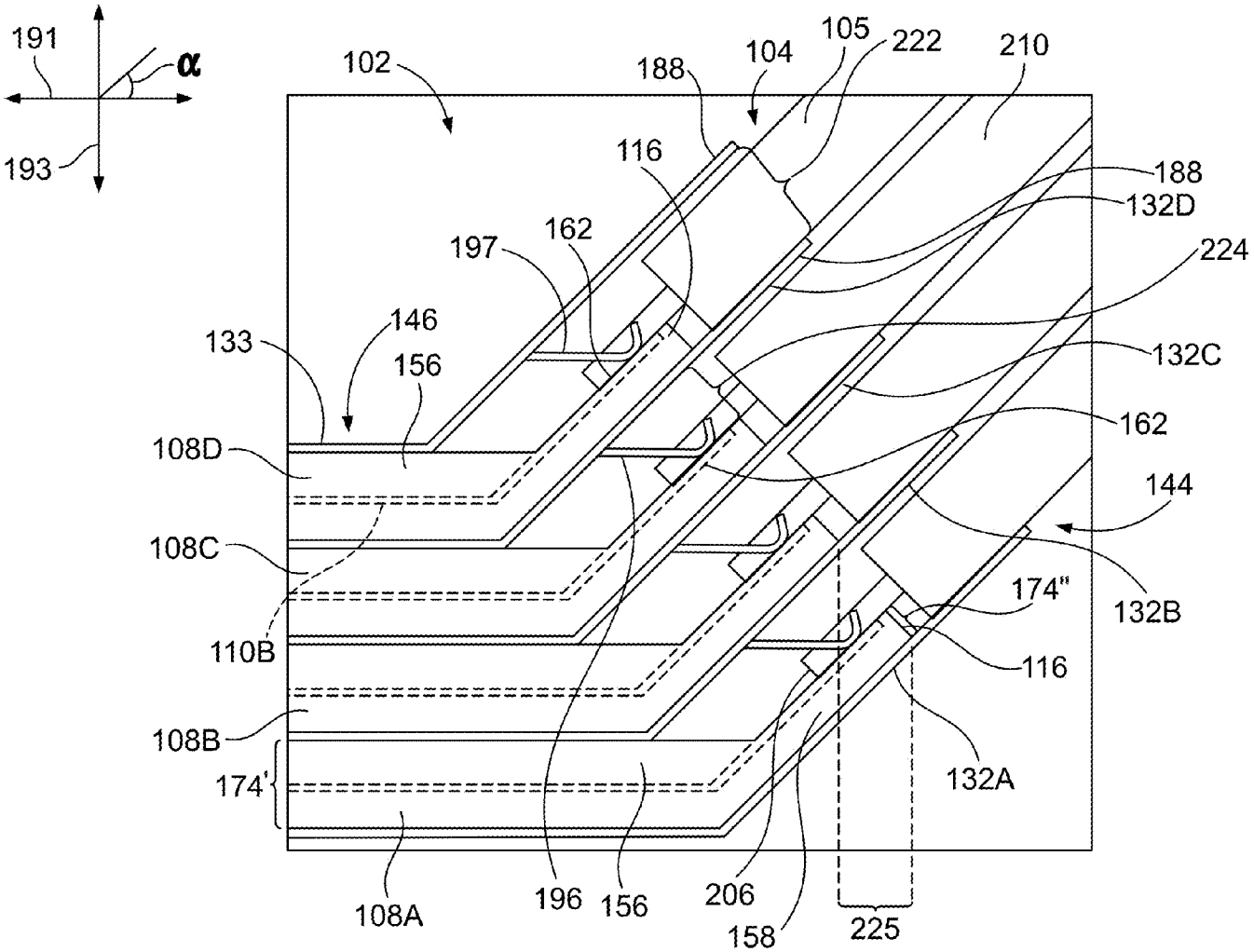
FIG. 6 is an enlarged side view of a loading side of the cable assembly of FIG. 1.
Figure 7:
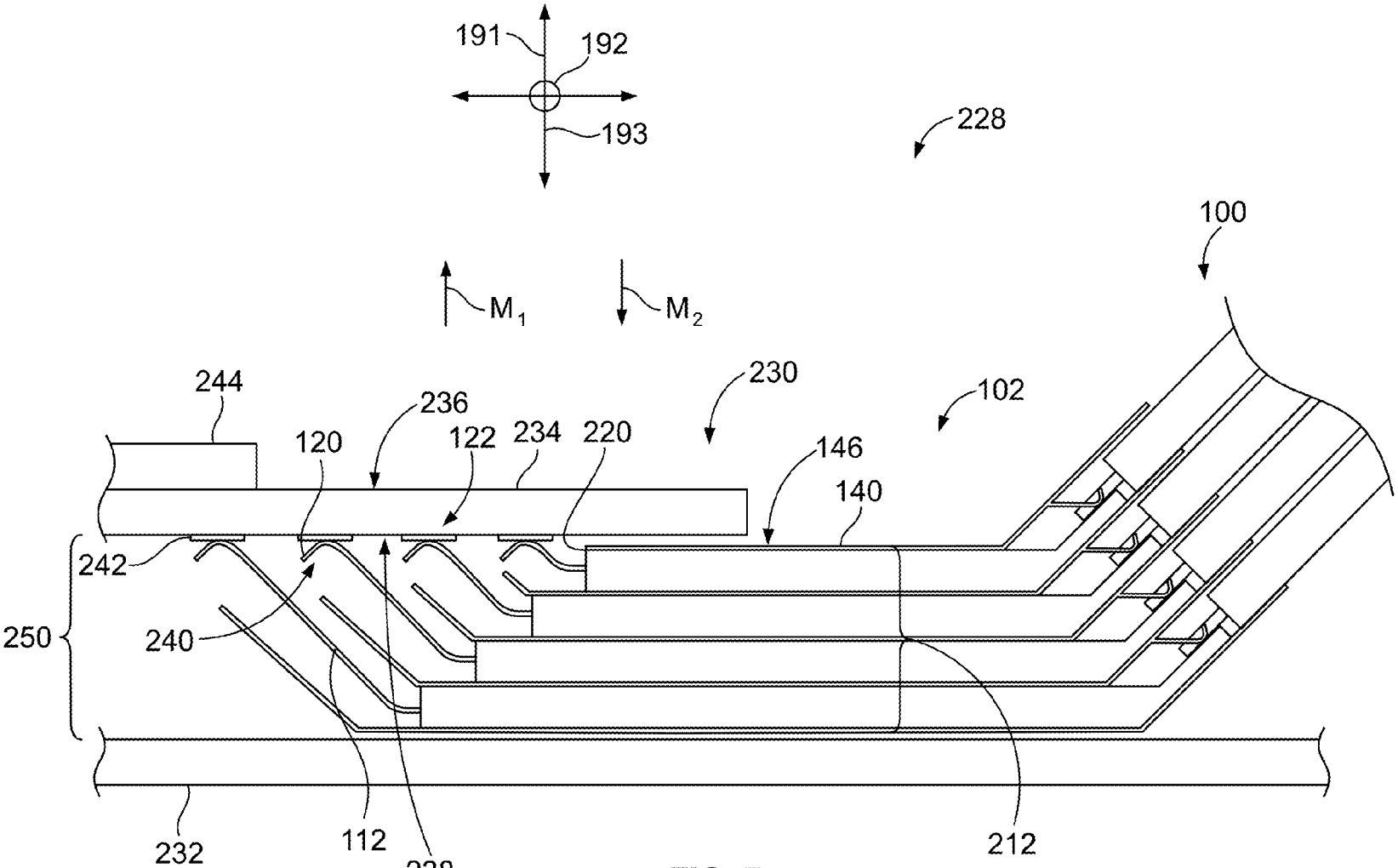
FIG. 7 is a side view of a portion of a communication system formed in accordance with an embodiment that includes the cable assembly of FIG. 1.

FIG. 6 is an enlarged side view of the loading side 144 of the cable connector 102. Unlike conventional cable connectors, the cable connector 102 may be configured to receive the insulated wires 104 and/or the cables 105 at a cable angle α that is non-parallel to the longitudinal axis 191. For example, the insulated wires 104 and/or the cables 105 may be coupled to the loading side 144 such that the insulated wires 104 and/or the cables 105 extend away from the loading side 144 at the cable angle α. The cable angle α may also be non-parallel to the first exterior side 146 or the array plane 216 (FIG. 5). For example, in the illustrated embodiment, the cable angle α is about +45° with respect to the longitudinal axis 191. Relative to the shield angle θ (FIG. 5), the cable angle α extends in an opposite direction along the longitudinal axis 191. The cable-terminating sections 158 of the module bodies 108A-108D may be planar bodies that are also oriented to extend at the cable angle α. In other embodiments, however, the cable angle α may be configured differently for other applications. For example, the cable angle α may be parallel to the longitudinal axis 191. Alternatively, the cable angle α may be about −45° with respect to the longitudinal axis 191 or may be perpendicular to the longitudinal axis 191.

For illustrative purposes, the electrical conductors 110 are indicated in phantom. As shown, each of the cable-terminating sections 158 of the module bodies 108A-108D extends from the corresponding conductor section 156 toward the corresponding back end 116. In the illustrated embodiment, the conductor sections 156 extend parallel to each other and to the longitudinal axis 191 and extend perpendicular to the mating axis 193. The cable-terminating sections 158 also extend parallel to each other, but at the cable angle α with respect to the longitudinal axis 191.

As shown with respect to the module body 108A, the conductor section 156 may have a thickness 174' that is greater than a thickness 174" of the cable-terminating section 158. In the illustrated embodiment, the thickness 174' along the conductor section 156 is more than two times (2×) the thickness 174" of the cable-terminating section 158. The thickness 174" of the cable-terminating section 158 may be reduced in order to expose the terminating segments 162 along the cable-terminating sections 158.

In some embodiments, the cable connector 102 includes cable-receiving gaps 222 and wire-receiving gaps 224 along the loading side 144. Each of the cable-receiving gaps 222 is an empty space or void along the loading side 144 that is configured to receive insulated wires 104 and/or cables 105. Each cable-receiving gap 222 may be defined between adjacent rearward panels 188. In the illustrated embodiment, the cable-receiving gaps 222 are configured to receive the jackets 210 of the cables 105. In some embodiments, the rearward panels 188 may determine the cable angle α at which the insulated wires 104 and/or cables 105 are received within the cable-receiving gaps 222.

Each of the wire-receiving gaps 224 is an empty space or void along the loading side 144 that is configured to receive the wire conductors 206. The wire-receiving gaps 224 may be defined between a cable-terminating section 158 and a rearward panel 188 that opposes the cable-terminating section 158.

The cable-receiving gaps 222 and the wire-receiving gaps 224 may be configured to receive insulated wires 104 and/or the cables 105 of predetermined sizes (e.g., gauges). Sizes of the cable-receiving gaps 222 and the wire-receiving gaps 224 may be based upon at least one of the cable angles α or dimensions of the module bodies 108A-108D. For example, the cable-receiving gaps 222 and/or the wire-receiving gaps 224 may be based, in part, on a longitudinal separation 225 between the back ends 116 of adjacent module bodies. Dimensions of the module bodies 108A-108D may be configured to increase or decrease the longitudinal distance 225 between the back ends 116. More specifically, as the longitudinal distance 225 increases, the cable-receiving gaps 222 and/or the wire-receiving gaps 224 increase in size. As the longitudinal distance 225 decreases, the cable-receiving gaps 222 and/or the wire-receiving gaps 224 decrease in size. Once the wires 104 are terminated to the terminating segments 162, the wire-receiving gaps 224 may be filled with a dielectric material, such as "hot melt," to improve the dielectric properties of the signal line and to provide mechanical support. Accordingly, the cable-receiving gaps 222 may be filled with a conductive material such as solder or conductive epoxy to complete the ground connection and to mechanically secure the cables to the connector 100.

As another example, each of the rearward panels 188 is oriented with respect to the longitudinal axis 191 to extend along the same cable angle α. In alternative embodiments, however, the rearward panels 188 may have different cable angles α. For example, the cable angle α of the rearward panel 188 of the ground shield 132D may be greater than the cable angle α of the rearward panel 188 of the ground shield 132C. In such embodiments, the cable-receiving gaps 222 and/or the wire-receiving gaps 224 may be configured to have desired sizes for receiving the insulated wires 104 and/or the cables 105.

Also shown in FIG. 6, the shield fingers 197 of the ground shield 133 may be mechanically and electrically coupled to corresponding terminating segments 162 of the ground conductors 110B along the module body 108D. Likewise, the shield fingers 196 of the ground shields 132B-132D may be mechanically and electrically coupled to corresponding terminating segments 162 along an adjacent module body. For example, the shield fingers 196 of the ground shield 132D may be mechanically and electrically coupled to corresponding terminating segments 162 along the adjacent module body 108C. Accordingly, each of the ground shields 132B-132D and the ground shield 133 may be electrically coupled to another ground shield. As described above with respect to FIG. 5, the ground shield 132A may be electrically coupled to the ground conductors 110B of the module body 108A. Thus, the ground shields 132A-132D, 133 may be electrically commoned to one another.

FIG. 7 is a side view of a portion of a communication system 228 that includes the cable assembly 100, a mating component 230, and a circuit board 232. In FIG. 7, the cable connector 102 and the mating component 230 have already undergone a mating operation such that the cable connector 102 and the mating component 230 are communicatively coupled. In an exemplary embodiment, the mating component 230 is a processor, such as a high performance processor or application specific integrated circuit. The mating component 230 may include a substrate 234 having opposite substrate surfaces 236, 238. The substrate surface 236 may be a top surface that faces in the mating direction $M_1$. The substrate surface 238 may be a bottom surface that faces in an opposite direction $M_2$ along the mating axis 193.

The substrate surface 238 includes an array 240 of pad contacts 242. The array 240 is also a 2D array and may be configured relative to the 2D array 122 such that each of the substrate pad contacts 242 engages a corresponding mating interface 120 of the 2D array 122 after the mating operation. The mating component 230 may include an integrated circuit 244 that is mounted to the substrate surface 236 of the substrate 234. The substrate 234 may be, for example, a circuit board. In an exemplary embodiment, the pad contacts 242 are electrically coupled to the integrated circuit 244 through traces and vias (not shown) of the substrate 234. In alternate embodiments, the substrate may be an organic integrated circuit package, a ceramic integrated circuit package, or other substrate type.

Prior to the mating operation, the cable connector 102 may be secured or mounted to the circuit board 232 in a fixed position. For example, the cable connector 102 may be coupled to a socket housing (not shown) that is configured to support the mating component 230. The mating component 230 may be positioned such that the substrate surface 238 faces the 2D array 122. As the mating component 230 is moved in the direction $M_2$ toward the cable connector 102, the array 240 and the 2D array 122 may be aligned so that each of the pad contacts 242 engages a corresponding mating interface 120. The pad contacts 242 (or the mating component 230) may deflect the contact beams 112 such that the mating interfaces 120 are moved in the direction $M_2$ toward the circuit board 232. When the cable connector 102 and the mating component 230 are communicatively coupled as shown in FIG. 7, the mating interfaces 120 are arranged parallel to the longitudinal axis 191 and parallel to the lateral axis 192.

Also shown in FIG. 7, the connector body 140 may be sized and shaped such that at least a portion of the connector body 140 may be positioned between the mating component 230 and the circuit board 232. More specifically, the operative vertical dimension 212 is less than a connector-receiving space 250 that is defined between the circuit board 232 and the substrate surface 238. When the mating component 230 and the cable connector 102 are communicatively engaged, the substrate surface 238 may extend alongside at least a portion of the first exterior side 146 that is proximate to the connector edge 220.

Figure 9:
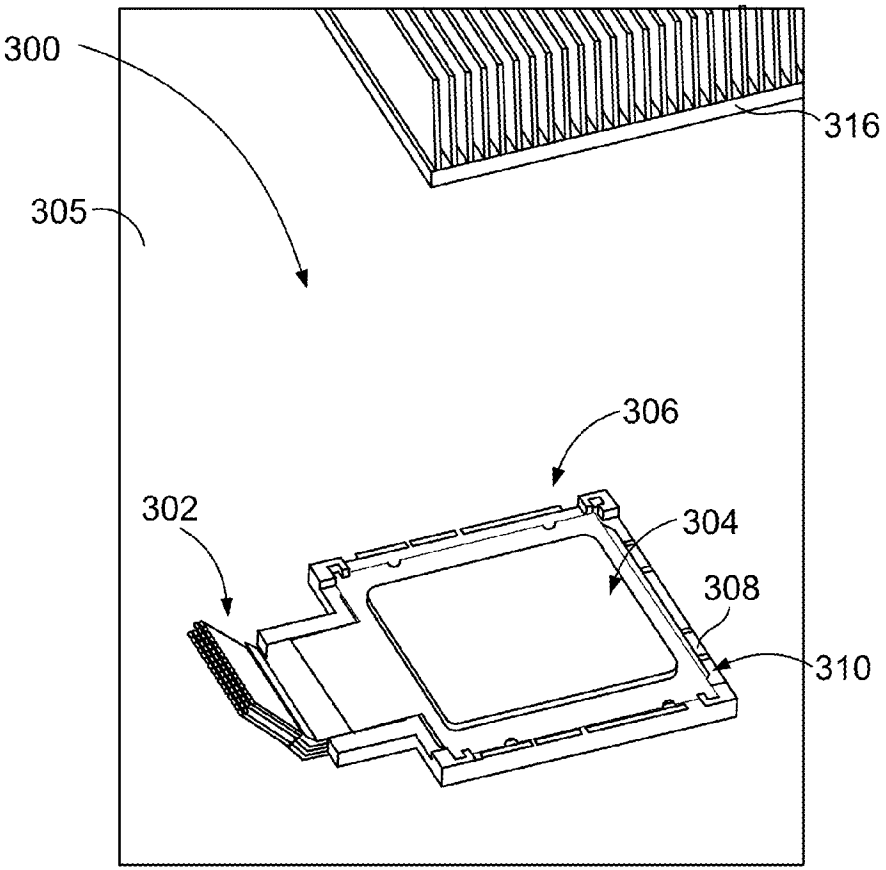
FIG. 9 is a perspective view of the communication system of FIG. 8 in which a mating component is mated with the cable assembly of FIG. 1.
Figure 8:
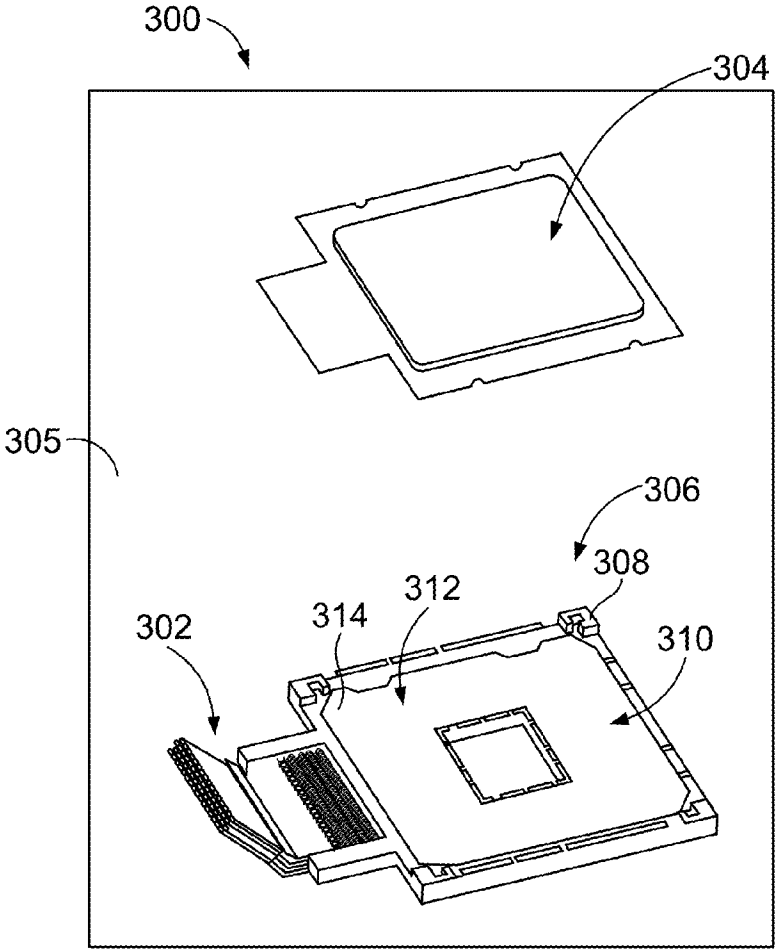
FIG. 8 is a partially exploded view of a communication system that includes the cable assembly of FIG. 1.

FIG. 8 is a partially exploded view of a communication system 300 formed in accordance with an embodiment, and FIG. 9 is a perspective view of a communication system 300 prior to a heat sink 316 being mounted onto the communication system 300. The communication system 300 may be similar to the communication system 228 (FIG. 7). For example, as shown in FIG. 8, the communication system 300 includes a cable assembly 302 and a mating component 304. The cable assembly 302 may be identical to the cable assembly 100 (FIG. 1). The mating component 304 is a processor, such as a high performance processor, that is configured to be mounted onto a land grid array (LGA) assembly 306 of the communication system 300. The LGA assembly 306 is mounted to a circuit board 305, such as a daughter card. The LGA assembly 306 includes a socket housing 308 that is secured to the circuit board 305 and defines a seating space 310. As shown in FIG. 8, the LGA assembly 306 also includes an array 312 of contact beams 314 that are exposed along the seating space 310. The contact beams 314 are electrically coupled to the circuit board 305 and extend through the socket housing 308. When the mating component 304 is positioned within the seating space 310, as shown in FIG. 9, the contact beams 314 may engage corresponding board contacts (not shown) of the mating component 304. The cable assembly 302 and the mating component 304 may communicatively engage each other as described above.

Figure 10:
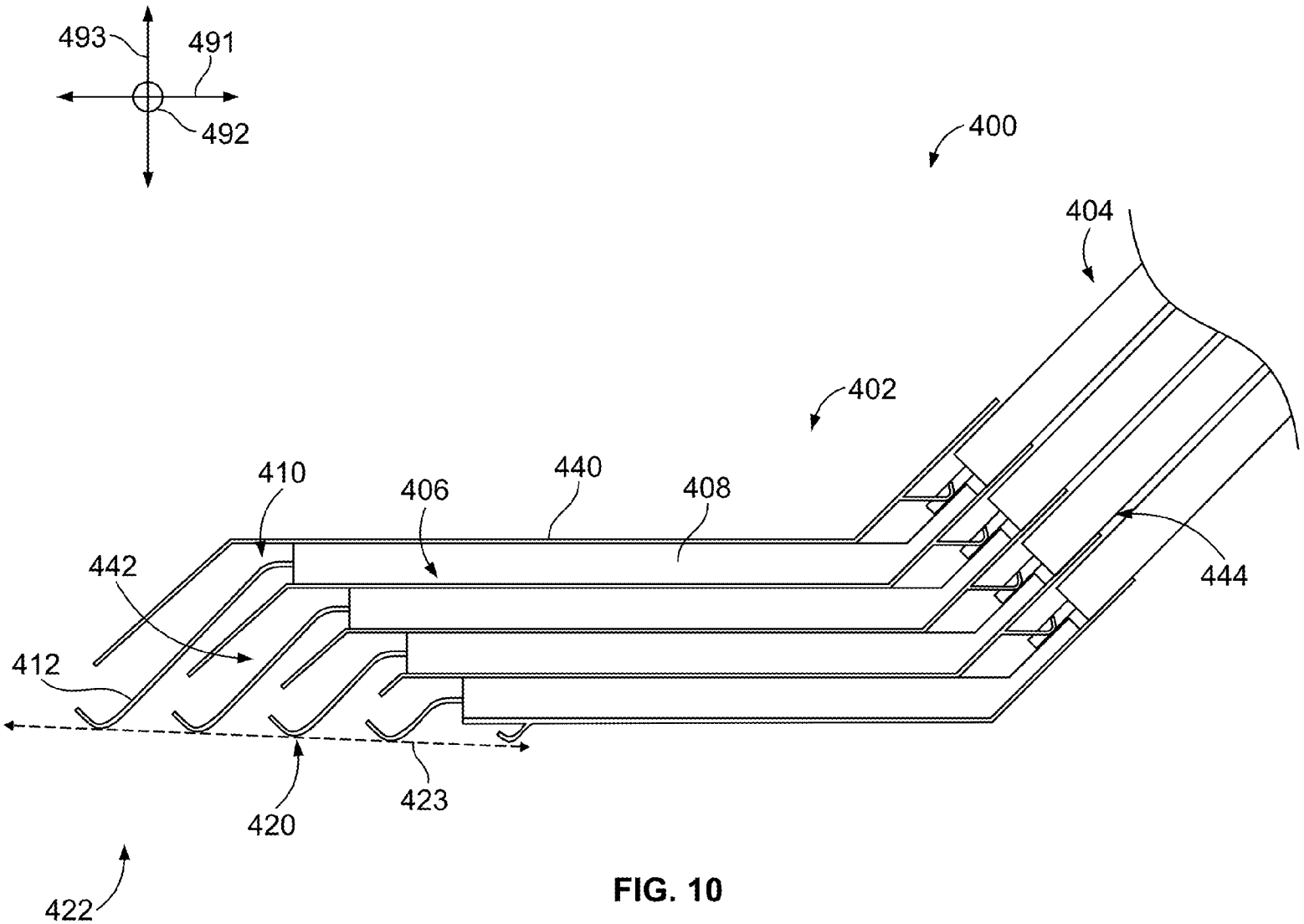
FIG. 10 is a side view of a cable assembly formed in accordance with an embodiment.

FIG. 10 is a side view of a cable assembly 400 formed in accordance with an embodiment. The cable assembly 400 is oriented with respect to mutually perpendicular axes 491, 492, 493, including a longitudinal axis 491, a lateral axis 492, and a mating axis 493. The cable assembly 400 may be similar to the cable assembly 100 and include a cable connector 402 that is coupled to a plurality of insulated wires 404. The cable connector 402 may include a connector body 440. The connector body 440 extends along the longitudinal axis 491 between a mating side 442 and a loading side 444 of the connector body 440. In an exemplary embodiment, the cable connector 402 includes a plurality of cable modules 406 that are stacked along the mating axis 493. Each of the cable modules 406 includes a module body 408 and a plurality of electrical conductors 410. Like the electrical conductors 110 (FIG. 1), the electrical conductors 410 have body segments (not shown) that extend through the connector body 440 between the mating and loading sides 442, 444 and contact beams 412 that project from the mating side 442. The contact beams 412 having mating interfaces 420 that are configured to directly engage corresponding electrical contacts (not shown) of a mating component (not shown). The contact beams 412 are shaped to extend along the longitudinal axis 491 and along the mating axis 493. The mating interfaces 420 form a two-dimensional (2D) array 422 in which the 2D array substantially coincides with an array plane 423 that extends perpendicular to the mating axis 493.

Unlike the cable connector 102 (FIG. 1), however, the module bodies 408 have identical sizes and shapes. Moreover, the 2D array 422 may face in an opposite direction compared to the 2D array 122. In such embodiments, the 2D array 422 may be used to directly engage a plurality of board contacts (not shown) that extend along a circuit board (not shown). However, it is contemplated that the cable connector 402 may also be positioned between two components as described above with respect to FIG. 7.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A cable connector comprising:

a connector body extending along a longitudinal axis between a mating side and a loading side of the connector body, the connector body being oriented with respect to a mating axis that is perpendicular to the longitudinal axis; and electrical conductors having body segments that extend through the connector body between the mating and loading sides and contact beams that project from the mating side, the contact beams having mating interfaces that are configured to directly engage corresponding electrical contacts of a mating component during a mating operation, the contact beams being shaped to extend along the longitudinal axis away from the mating side and along the mating axis such that the mating interfaces form a two-dimensional (2D) array that is oriented substantially perpendicular to the mating axis;

wherein the contact beams that form the 2D array project from the mating side at corresponding projection points, each of the projection points having a Z-position relative to the mating axis, wherein at least some of the Z-positions of the projection points are different.

2. The cable connector of claim 1, further comprising a plurality of cable modules stacked side-by-side along the mating axis to form the connector body, each of the cable modules including a module body that holds a plurality of the electrical conductors, the contact beams projecting from the corresponding module bodies at the corresponding projection points.

3. The cable connector of claim 1, wherein the 2D array extends parallel to the longitudinal axis and a lateral axis, the lateral axis being perpendicular to the mating axis and the longitudinal axis.

4. The cable connector of claim 1, wherein the contact beams have respective lengths, at least some of the contact beams having a common length and at least some of the contact beams having different lengths.

5. The cable connector of claim 1, wherein a beam plane that is perpendicular to the mating axis intersects each of the contact beams that form the 2D array, wherein the contact beams include beam segments that extend between the corresponding projection points and the corresponding mating interfaces, at least some of the beam segments forming a non-orthogonal angle with respect to the beam plane.

6. The cable connector of claim 1, wherein the contact beams are configured to flex along the mating axis when the mating interfaces are engaged and deflected by the mating component during the mating operation.

7. The cable connector of claim 1, wherein the electrical conductors include terminating segments that are exposed along the loading side of the connector body, the terminating segments having respective Z-positions relative to the mating axis, wherein a first plurality of the terminating segments have a first Z-position and a second plurality of the terminating segments have a different second Z-position, the terminating segments having respective wire conductors terminated thereto to form a cable assembly.

8. A cable connector comprising:

a plurality of cable modules stacked side-by-side along a mating axis to form a connector body, the connector body extending along a longitudinal axis that is perpendicular to the mating axis between a mating side and a loading side of the connector body, each of the cable modules including a module body and a plurality of electrical conductors extending along the longitudinal axis through the module body, the electrical conductors including signal conductors and ground conductors; and a ground shield positioned between the module bodies of adjacent cable modules, the ground shield engaging the ground conductors of at least one of the adjacent cable modules such that the ground conductors are electrically commoned;

wherein the electrical conductors of the cable modules include contact beams that project from the module bodies at the mating side of the connector body and are shaped to extend along the longitudinal axis and the mating axis, the contact beams having mating interfaces configured to directly engage corresponding electrical contacts of a mating component, the contact beams being shaped such that the mating interfaces form a two-dimensional (2D) array that is oriented substantially perpendicular to the mating axis.

9. The cable connector of claim 8, wherein the contact beams have respective lengths, at least some of the contact beams having a common length and at least some of the contact beams having different lengths.

10. The cable connector of claim 8, wherein each of the module bodies includes a cable-terminating section along the loading side of the connector body, the electrical conductors having terminating segments that are exposed at the cable-terminating sections of the corresponding module bodies, the terminating segments having respective Z-positions relative to the mating axis and the cable modules including first and second cable modules, wherein the terminating segments of the first cable module have a first Z-position and the terminating segments of the second cable module have a different second Z-position, the terminating segments having respective wire conductors terminated thereto to form a cable assembly.

11. The cable connector of claim 8, wherein the module bodies include a first module body and a second module body, each of the first and second module bodies including a front end and a back end that define a length of the respective module body therebetween that is measured along the longitudinal axis, the length of the first module body being greater than the length of the second module body, wherein the module bodies include a third module body having a length that is defined between a front end and a back end of the third module body, wherein the length of the third module body is not equal to the length of the first module body or the length of the second module body.

12. The cable connector of claim 8, wherein the ground shield includes shield fingers, the shield fingers engaging the ground conductors of the at least one adjacent cable module.

13. The cable connector of claim 12, wherein the module body of the at least one adjacent cable module has recesses that provide access to the ground conductors, the shield fingers extending through the recesses to engage the ground conductors.

14. The cable connector of claim 8, wherein the ground shield includes opposite first and second side surfaces, the ground shield including shield fingers that project from the first side surface and shield fingers that project from the second side surface.

15. The cable connector of claim 8, wherein the ground shield is a first ground shield and the cable connector includes a second ground shield, the first and second ground shields being electrically commoned.

16. The cable connector of claim 8, wherein the ground shield includes a forward panel that extends from the mating side and between the contact beams of adjacent cable modules.

17. The cable connector of claim 8, wherein the ground shield and the module body of one of the adjacent cable modules define a wire-receiving gap therebetween and wherein a plurality of wire conductors are positioned within the wire-receiving gap and electrically coupled to the electrical conductors to form a cable assembly.

18. The cable connector of claim 8, wherein a plurality of cables that each have a pair of insulated wires are electrically coupled to the electrical conductors to form a cable assembly, the signal conductors being arranged to form differential pairs in which adjacent differential pairs are separated by at least one of the ground conductors.

19. The cable connector of claim 18, wherein the 2D array has at least 35 mating interfaces per 100 $mm^2$.

20. The cable connector of claim 1, wherein the electrical conductors include signal conductors and ground conductors, wherein a plurality of cables that each have a pair of insulated wires are electrically coupled to the electrical conductors to form a cable assembly, the signal conductors being arranged to form differential pairs in which adjacent differential pairs are separated by at least one of the ground conductors.

* * * * *